US005974965A

United States Patent [19]

Ciofalo et al.

[11] Patent Number: 5,974,965

[45] Date of Patent: Nov. 2, 1999

[54] SINGLE POINT QUICK DISCONNECT SPRAY BAR

[75] Inventors: John Ciofalo, New Milford; Robert W. MacDonald, Ridgefield, both of Conn.

[73] Assignee: Baldwin Graphic Syetems, Inc., Shelton, Conn.

[21] Appl. No.: 08/792,783

[22] Filed: Feb. 3, 1997

[51] Int. Cl.[6] ..... B41F 7/30

[52] U.S. Cl. ..... 101/147; 101/148

[58] Field of Search ..... 101/147, 148, 101/366, 350, 216, 365

[56] References Cited

U.S. PATENT DOCUMENTS 3,898,929 8/1975 Arild et al. ..... 101/147
4,708,058 11/1987 Smith ..... 101/147
4,821,641 4/1989 Kowalik et al. ..... 101/148
4,831,927 5/1989 Lin ..... 101/148

*Primary Examiner*—Christopher A. Bennett
*Attorney, Agent, or Firm*—Morgan & Finnegan, LLP

[57] ABSTRACT

A single point quick disconnect spray bar is disclosed for movement between a connected position, in which the spray bar is operatively connected to a press frame, and a disconnected position. A mounting guide secured to the spray bar is engagable with the press frame and movably supports the spray bar in the disconnected position when so engaged. A closure member, having a first part affixed to a first end of the spray bar and a second end affixed to the press frame moves the spray bar into the connected position when the first and second parts are engaged. A method of connecting a spray bar is also disclosed.

5 Claims, 4 Drawing Sheets

SINGLE POINT QUICK DISCONNECT SPRAY BAR

BACKGROUND OF THE INVENTION

1. Field of the Invention

The present invention relates generally to a spray bar for use in a printing press and, more particularly, to a spray bar that may be connected and disconnected from the press quickly, without the need for external tools through manual intervention at only one end thereof.

2. Description of Related Art

It is well known in the art to use spray bars for applying a dampening fluid to either a dampening roller or an ink roller of a printing press. The conventional spray bar, which mounts onto the printing press, houses solenoids, nozzles, wiring, plumbing, as well as other components. Additionally, mounting rods and upper and lower covers are attached to the spray bar. When attaching the spray bar to the press, the electrical and fluid connections must be made, and both the left and right hand clamps which hold the mounting rods to the press frame must be tightened. Typically, the hand clamps are split collar clamps having a locking nut. A typical double line newspaper press has a spray bar weighing in the range of approximately 65 to 70 pounds.

When servicing the conventional spray bar, other than changing a nozzle, the entire bar must be removed from the press. This involves disconnecting the electrical connections from the spray bar, disconnecting the fluid supply system from the spray bar, removing a drainage line from spray bar, unclamping both the left and right hand clamps, and simultaneously lifting both ends of the spray bar from the press. Accordingly, it is clear that conventional spray bars have traditionally suffered from several disadvantages.

In particular, removal and connection of the spray bar is unduly complicated. Manual disconnection of the electrical and fluid connections increases the downtime of the press. Similarly, that the left and right clamps must both be undone further adds to the downtime of the press. Lastly, because the mounting rods and upper and lower covers are permanently affixed to the spray bar, the spray bar is often particularly heavy, making removal difficult.

Efforts have been made to simplify the maintenance of the spray bar. These advancements include providing the spray bar with the fluid and electrical connections at one end for plugging into a mating receptacle positioned on the press frame. After making the fluid and electrical connections, the bar is secured in place with a screw located on the opposite end of the bar. While such a spray bar has reduced to the downtime due to the manual connection and disconnection of the fluid and electrical supplies, this bar also has several drawbacks.

Specifically, alignment of the mating portions of the fluid and electrical connections can be difficult. Also, the screw used to secure the bar in place is typically not locking or torque limiting. Therefore, the screw may loosen causing the spray bar to fall from the press. Additionally, the use of a screw at one end of the bar places undue torque on the spray bar, possibly resulting in bending of the bar. Similarly, the screw places undue torque on the press frame as well. Lastly, an external tool usually is required to tighten the screw.

It is therefore an object of the present invention to provide a single point quick disconnect spray bar.

It is another object of the present invention to provide a single point quick disconnect spray bar that is easily connected and disconnected.

It is another object of the present invention to provide a single point quick disconnect spray bar which is easily maintained.

It is still another object of the present invention to provide a single point quick disconnect spray bar that is self aligning.

It is still another object of the present invention to provide a single point quick disconnect spray bar that is secured to a press without the need for external tools.

It is still another object of the present invention to provide a single point quick disconnect spray bar that is light in weight.

It is a further object of the present invention to provide a single point quick disconnect spray that does not place undue torque on the bar or the press.

It is yet another object of the present invention to provide a single point quick disconnect spray bar that is secured to the press frame through manual intervention at only one end thereof.

SUMMARY OF THE INVENTION

In accordance with the aforementioned objects, a single point quick disconnect spray bar of the present invention, having a first end and a second end, is provided for movement between a connected position, wherein the spray bar is securely and operationally connected to a press frame, and a disconnected position, wherein the spray bar is supportably mounted on the press frame. A first mounting guide is affixed to the spray bar and is engagable with the press frame, the spray bar being in the disconnected position when the mounting guide is engaged with the press frame. A closure member having a first part affixed to the first end of the spray bar engagable with a second part affixed to the press frame, is also provided. The spray bar is in the connected position when the parts are engaged and in the disconnected position when the parts are disengaged.

DETAIL DESCRIPTION OF THE PREFERRED EMBODIMENTS

Figure 1:
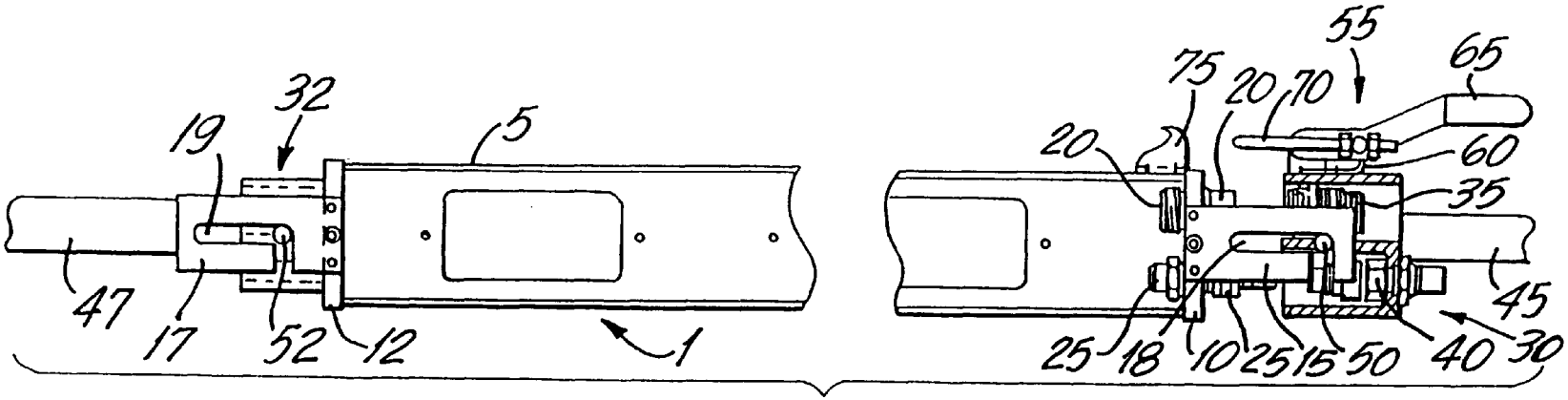
FIG. 1 is a rear plan view of the single point quick disconnect spray bar of the present invention.

Turning to FIG. 1, a single point quick disconnect spray bar 1 of the present invention is shown. A pair of mounting brackets 30, 32 is disposed on the press frame, one at each end of the spray bar 1. An overcenter draw clamp 55 is located at a first end of the spray bar 1.

More specifically, the spray bar 1 comprises a U shaped mounting channel 5 having a first end plate 10 located at a first end of the mounting channel 5 and a second end plate 12 located at a second end of the mounting channel 5. The end plates 10, 12 are securely mounted to the mounting channel 5. The first end plate 10 has a male electrical connector 20 and a male fluid connector 25 passing therethrough. Although not shown in FIG. 1, electrical wiring extends from the end of the male connector 20 that is within the mounting channel 5 for controlling the solenoid valves (not shown). Similarly, tubing extends from the end of the male fluid connector 25 that is within the mounting channel 5 to provide dampening fluid to the nozzles (also not shown). Also located at the first end of the spray bar 1, is an overcenter draw clamp hook 75. The hook 75 is securely mounted on the top of the mounting channel 5 by any suitable means.

A mounting guide plate 15, 17 is mounted on each end plate 10, 12. More specifically, each mounting guide plate 15, 17 is mounted on a rear surface of the corresponding end plate 10, 12. The mounting guide plates 15, 17 serve to support the spray bar 1 and place it in proper alignment with respect to the mounting brackets 30, 32 for operable connection. A first mounting guide plate 15 has a channel cutout 18 therein. The channel 18 includes a vertical section as well as a section extending laterally along the axis of and towards the spray bar 1. A second mounting plate 17 is securely mounted to the rear surface of the second end plate 12. Like the first mounting plate 15, the second plate 17 has a channel cutout 19 therein. As will be discussed below, it is necessary that the laterally extending portions of the channels 18, 19 extend in the same direction with respect to the vertical section of the channels 18, 19. Specifically, as shown in FIG. 1, the laterally extending portions of the channels 18, 19 extend to the left.

The mounting brackets 30, 32 will now be discussed in more detail. The mounting brackets 30, 32 are permanently affixed to mounting rods 45, 47. Each mounting rod 45, 47 in turn, is permanently affixed to the press frame (not shown). Each mounting bracket 30, 32 has a shoulder bolt 50, 52 extending from a rear surface thereof. A first mounting bracket 30 is adjacent to the first end of the spray bar 1 which houses the male electrical connector 20 and the male fluid connector 25. The first mounting bracket 30 houses the corresponding female electrical connector 35 and the female fluid connector 40. Although not shown, the female electrical connector 35 is connected to electrical wiring and a power supply, and the female fluid connector 40 is connected to a fluid supply conduit and a fluid supply. An overcenter draw clamp 55 is mounted at the top of the first mounting bracket 30.

By utilizing the mounting brackets 30, 32, the spray bar can be made significantly lighter in weight. Unlike conventional spray bars, the spray bar 1 of the present invention does not include the mounting rods 45, 47. Additionally, the surface of the mounting brackets 30, 32 can be utilized for mounting both upper and lower covers as well as end spray guards.

Figure 2:
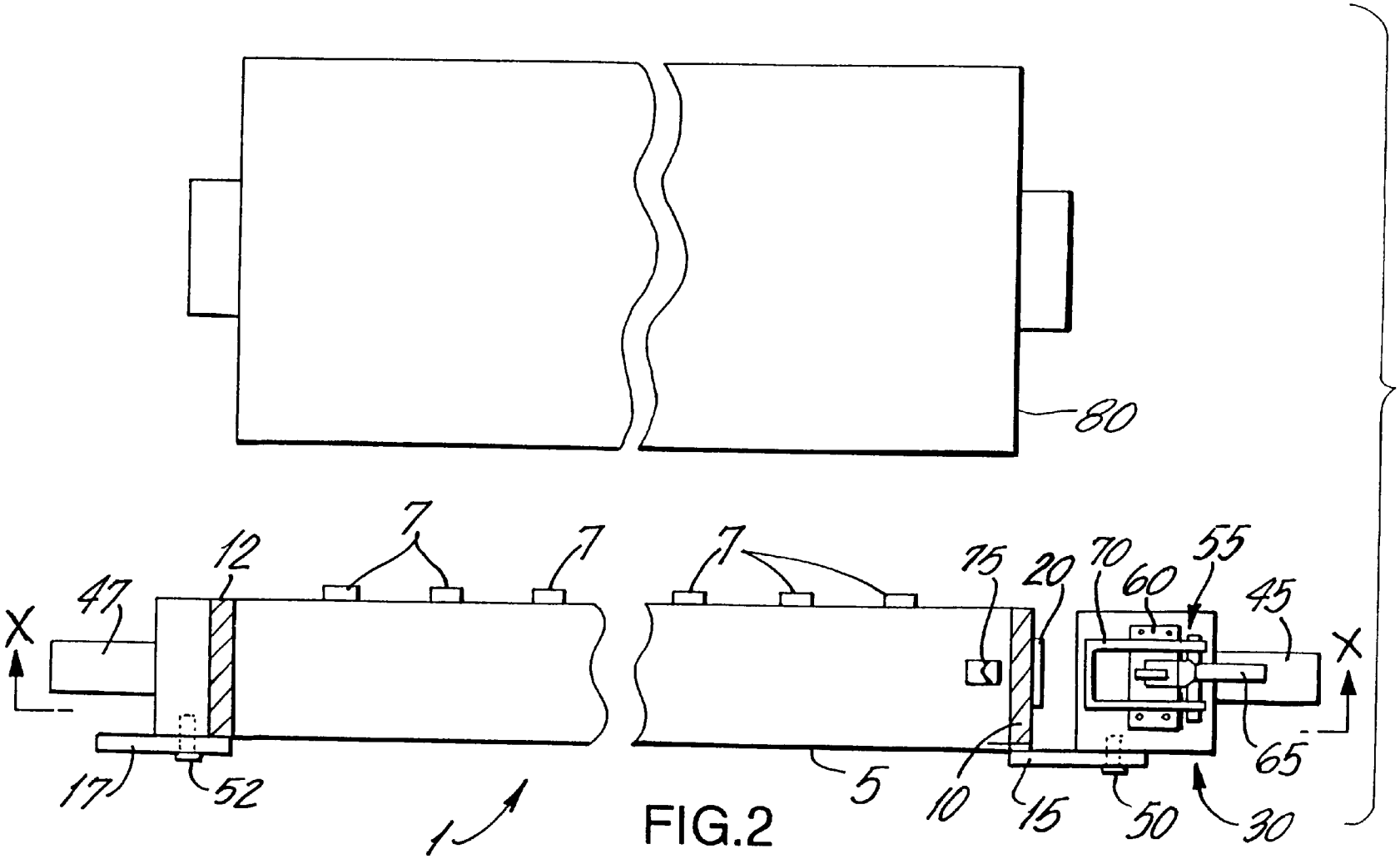
FIG. 2 is a top plan view of the single point quick disconnect spray bar of the present invention showing the spray bar in a disconnected position in relationship to a press roller on which the spray bar will apply a dampening water.

When mounting the spray bar 1 on the mounting brackets 30, 32, the spray bar 1 is positioned over the mounting brackets 30, 32 so that the vertical section of each channel 18, 19 in the mounting guide plates 15, 17 aligns with the corresponding shoulder bolt 50, 52. The spray bar 1 is then dropped into place so that each shoulder bolt 50, 52 engages the channel 18, 19. Once the spray bar 1 is dropped into place, it is supported on the shoulder bolts 50, 52. In order to simplify engagement of the guide plate 15, 17 with the shoulder bolts 50, 52, the opening of each channel 18, 19 is preferably wider than the shoulder bolt 50, 52. However, to prevent movement of the spray bar 1 once the guide plates 15, 17 have engaged the bolts 50, 52, the channels 18, 19 are substantially the same width as the shoulder bolts 50, 52. For ease of attachment, the bar 1 may be positioned by first engaging the second mounting guide 17 with the second bolt 52, on which the bar 1 may be supported and pivoted for engagement of the first mounting guide plate 15 with the first bolt 50. As shown in FIG. 2, the shoulder bolts 50, 52 are preferably fitted with a head that is larger than the channels 18, 19 so as to prevent the spray bar 1 from accidentally disengaging the mounting brackets 30, 32.

As can be seen in FIG. 1, the interaction of the shoulder bolts 50, 52 and mounting guide plates 15, 17 insure that the spray bar 1 is aligned with the mounting brackets 30, 32. More specifically, when the mounting guide plates 15, 17 are engaged with the shoulder bolts 50, 52, the male electrical connector 20 is coaxially aligned with the female electrical connector 35. Likewise, the male fluid connector 25 is coaxially aligned with the female fluid connector 40.

Figure 4:
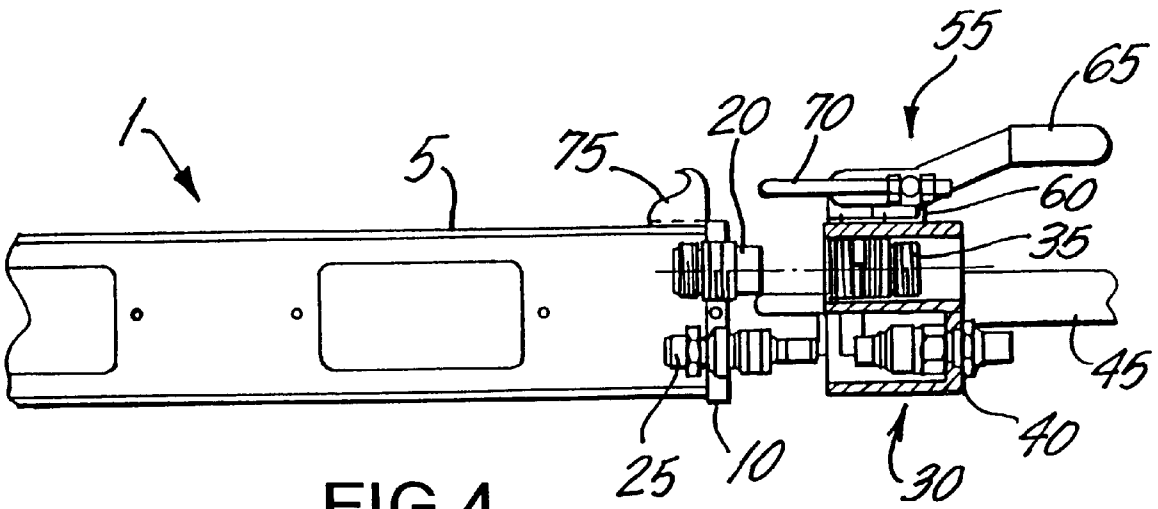
FIG. 4 is a rear sectional view taken along line X—X in FIG. 2 of a first end of the single point quick disconnect spray bar of the present invention showing the electrical and fluid connections in a disconnected position.

The alignment of the male connectors 20, 25 with the female connectors 35, 40 can best be seen in FIG. 4. FIG. 4 illustrates a sectional view of the spray bar 1 and first mounting bracket 30 of the spray bar 1 in an identical position as shown in FIG. 1. The view is taken along line X—X in FIG. 2 so that the alignment of the electrical and fluid connectors can be seen. With the proper alignment being insured by the interaction between the mounting guide plates 15, 17 and the shoulder bolts 50, 52, the spray bar 1 may be drawn into position.

The overcenter draw clamp 55 draws the spray bar 1 into a connected, operational position. Specifically, the overcenter draw clamp 55 comprises a base 60, which is securely affixed to the first mounting bracket 30, a lever 65, which is pivotally mounted to the base 60, and a latch 70, which is pivotally mounted on the lever 65. In operation, the lever 65 is pivoted forward, towards the spray bar 1 so that the latch 70 engages the hook 75. When the lever 65 is moved back to its original position, away from the spray bar 1, engagement of the latch 70 and hook 75 causes the spray bar to be drawn towards the overcenter draw clamp 55 and the first mounting bracket 30 on which it is affixed. As the overcenter draw clamp 55 is latched, the spray bar 1 slides on the shoulder bolts 50, 52 causing each shoulder bolt 50, 52 to further engage the lateral portion of each channel 18, 19 in each of the mounting guide plates 50, 52.

Figure 3:
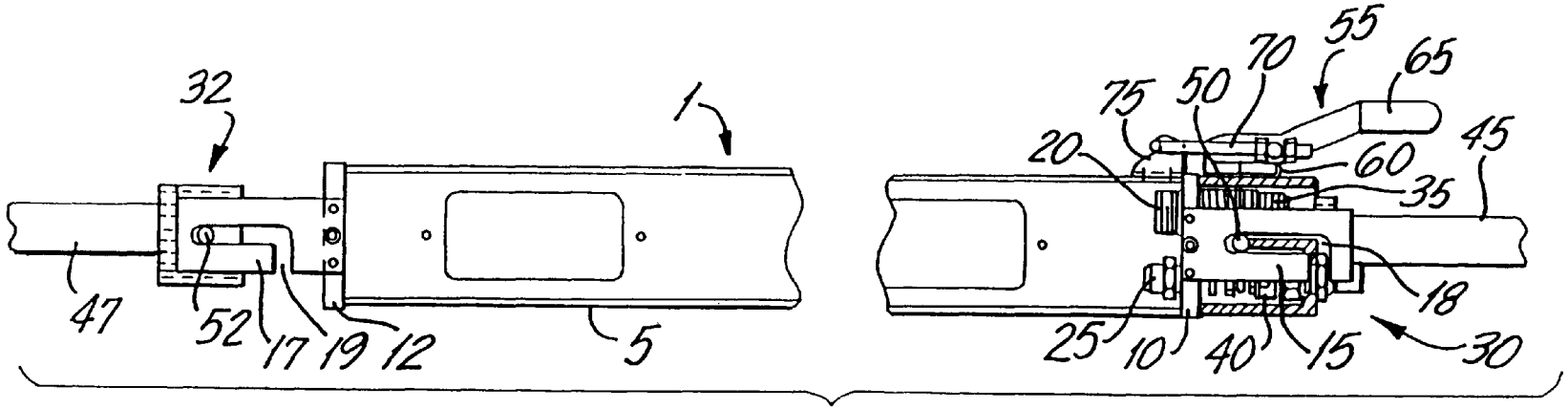
FIG. 3 is a rear plan view of the single point quick disconnect spray bar of the present invention in a connected, operational position.
Figure 5:
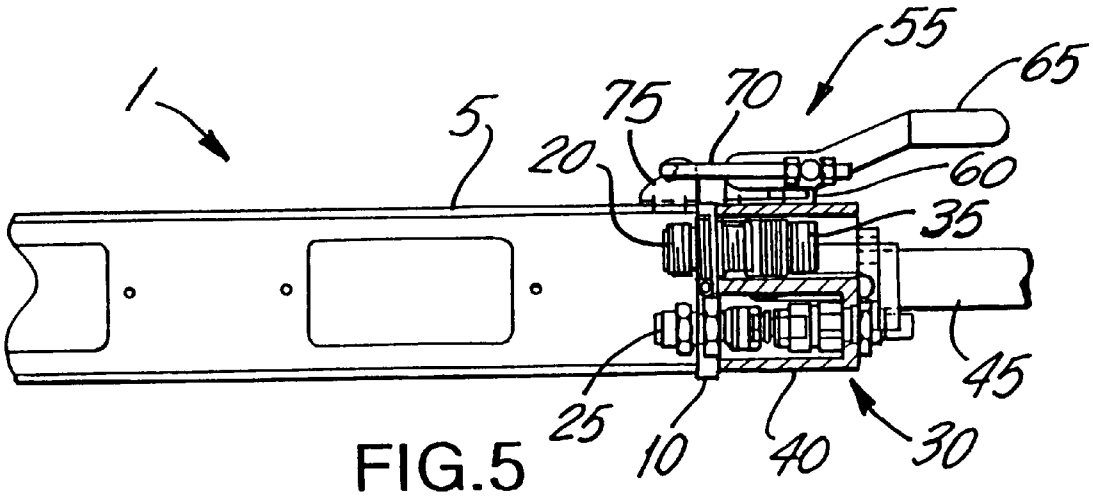
FIG. 5 is a rear sectional view taken along line X—X in FIG. 2 of the first end of the single point quick disconnect spray bar showing the electrical and fluid connections in a connected position.

As can be seen in FIG. 3, closure of the overcenter draw clamp 55 positions the spray bar 1 into a connected, operational position, in which it is securely connected to the mounting brackets 30, 32. In the connected, operational position, the male electrical connector 20 is fully engaged with the female electrical connector 35, thereby allowing power to flow to the spray bar 1. Similarly, the male fluid connector 25 is fully engaged with the female fluid connector 40, thereby allowing dampening fluid to flow to the spray bar 1. Engagement of the male 20, 25 and female 35, 40 connectors can best be seen in FIG. 5. FIG. 5 is an identical illustration of the first end of the spray bar 1 and the first mounting bracket 30 as in FIG. 3, with the exception that the view is sectional, taken along line X—X in FIG. 2 so that the electrical and fluid connections can be seen.

In an alternate embodiment, the latch 70 is replaced with a "J-shaped" hook, and the hook 75 is replaced with a hole that is punched into the top surface of the mounting channel 5. In operation, the J-shape hook engages the hole so that the spray bar 1 may be drawn into the connected position. Additionally, placement of a second hole the bottom surface of the mounting channel 5 allows the spray bar 1 to be reversible.

Figure 6:
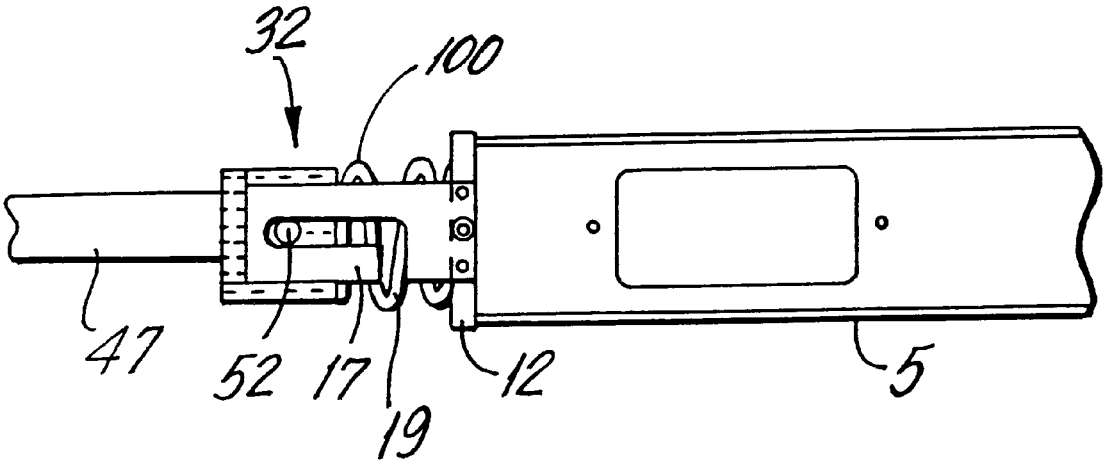
FIG. 6 is a rear plan view of an alternate embodiment of the single point quick disconnect spray bar of the present invention in a connected, operational position.

It is to be understood that other mechanisms for moving the spray bar from a disconnected position to a connected, operational position are within the scope of the present invention. As shown in FIG. 6, in addition to an overcenter draw clamp, suitable closure members include a spring 100 positioned at the second end of the spray bar 1, the spring being initially compressed when placing the mounting guide plates 15, 17 on the shoulder bolts 50, 52 and then expanding to force the spray bar 1 into a connected position. Other suitable closure members include: a hydraulic cylinder, an air cylinder, a screw, and the like to urge the spray bar 1 into a connected position.

It is preferable that the electrical and fluid connectors are pluggable. That is, they should be self-engaging and not require manual tightening or other intervention. Suitable electrical connectors include AMPHENOL brand connectors. Suitable fluid connectors include SWAGELOK brand fittings. It should also be noted that the location of the male 20, 25 and female 35, 40 connectors with respect to the spray bar 1 is not critical. For example, the connectors could be placed at the second end of the spray bar 1 rather than at the first end. Similarly, the male connectors 20, 25 could be located in either mounting bracket 30, 32 with the female connectors 35, 40 located in the adjacent end of the spray bar 1. Furthermore, in an alternate embodiment, the connectors are located side-by-side rather than one on top of the other.

Additionally, it should be noted that other arrangements of mounting guide plates and shoulder bolts are within the scope of the present invention. For example, the shoulder bolts could be positioned on each end plate with a receiving mounting guide plate on each mounting bracket.

While the present invention has been described with reference to particular embodiments, other embodiments that are apparent to those of ordinary skill in the art are also intended to be within the scope of this invention. Accordingly, the scope of this invention is not to be limited to the embodiments disclosed and illustrated herein, but is intended to be limited only by the claims appended hereto.

What is claimed is:

1. A spray bar for single point quick disconnect from a press frame, the spray bar comprising:

a mounting means affixed to the spray bar for slidably supporting the spray bar on the press frame; and a closure means adjacent the press frame interposed between the spray bar and the press frame for positioning the spray bar in an operational position, wherein said closure means is a spring.

2. A method for connecting a spray bar to a press frame the spray bar having two ends, the method comprising the steps of:

supporting the two ends of the spray bar on a mounting guide prior to operatively connecting the spray bar to the press frame;

aligning the spray bar for operative connection to the press frame; and drawing the spray bar into operative connection with the press frame through manual intervention at one end of the spray bar after supporting the spray bar, wherein said step of drawing the spray bar into operative connection includes latching a first closure member secured to said one end of the spray bar with a second closure member secured to the press frame adjacent said one end of the spray bar.

3. The method of claim 2 wherein said step of drawing the spray bar into operative connection includes electrically connecting a first electrical connector secured to the spray bar with a mating electrical connector secured to the press frame.

4. The method of claim 3 wherein said step of drawing the spray bar into operative connection includes placing a first fluid connector secured to the spray bar into fluid connection with a mating fluid connector secured to the press frame.

5. The method of claim 2 wherein said step of supporting the spray bar on said mounting guide automatically aligns the spray bar for operative connection.

* * * * *